US005702627A

United States Patent [19]

Braskén

[11] Patent Number: 5,702,627

[45] Date of Patent: Dec. 30, 1997

[54] UNINSULATED AND INSULATED CONCRETE BUILDING STRUCTURE PRODUCTION IN SITU

[76] Inventor: Walter Braskén, 615 Pleasant Bay Rd., Bellingham, Wash. 98226

[21] Appl. No.: 411,428

[22] Filed: Mar. 27, 1995

[51] Int. Cl.[6] ..... E04G 11/06

[52] U.S. Cl. ..... 249/33; 249/47; 249/83; 249/91

[58] Field of Search ..... 249/33, 47, 91, 249/83; 52/404.1, 405.1, 405.2, 405.3

[56] References Cited

U.S. PATENT DOCUMENTS

| | | | |
|---|---|---|---|
| 3,750,355 | 8/1973 | Blum | 52/309 |
| 4,292,783 | 10/1981 | Mulvihill | 52/741 |
| 4,329,821 | 5/1982 | Long | 52/309.12 |
| 4,393,635 | 7/1983 | Long | 52/309.11 |
| 4,422,271 | 12/1983 | Auzinger | 52/302 |
| 4,426,061 | 1/1984 | Taggart | 249/45 |
| 4,541,211 | 9/1985 | Garrett | 52/98 |
| 4,545,163 | 10/1985 | Asselin | 52/378 |
| 4,708,315 | 11/1987 | Carlson | 249/192 |
| 4,805,366 | 2/1989 | Loug | 52/309.11 |
| 4,829,733 | 5/1989 | Loug | 52/309 |
| 5,119,606 | 6/1992 | Graham | 52/125.4 |
| 5,222,338 | 6/1993 | Hull | 52/405 |

*Primary Examiner*—Thomas R. Weber

[57] ABSTRACT

A new and unique method of forming and pouring concrete walls is described wherein concrete walls are constructed with unprecedented speed, precision, and flexibility. This is accomplished through the use of preformed corner or angle units working in conjunction with unique forming panels. With the speed of assembly of the forming units a "form and pour as you go" method is utilized which allows the entire structure to be finished in one monolithic pouring of concrete. The method is adaptable to the construction of large or small structures. The method may be used for homes, commercial buildings, public buildings, and for other shelters. The walls so produced may be intrinsically insulated at the time of construction. Cost savings are considerable through the reduction of the amount of labor required and through the use of ordinary building materials that are readily available. The unique more expensive forming equipment can be reused many times and the cost per use would be negligible. A provision is made to make such structures aesthetically acceptable and to avoid the monotonous fortress-like appearance that has characterized the appearance of most concrete structures in the past. It is felt that this wall forming method represents a significant step toward the more widespread use of concrete as the primary building material in general construction.

6 Claims, 7 Drawing Sheets

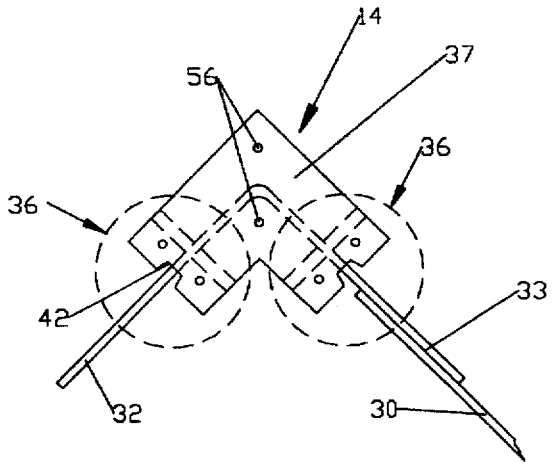
FIG 3
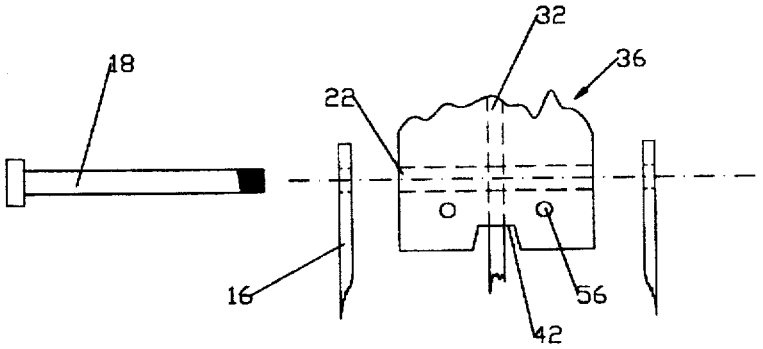
FIG 3-A
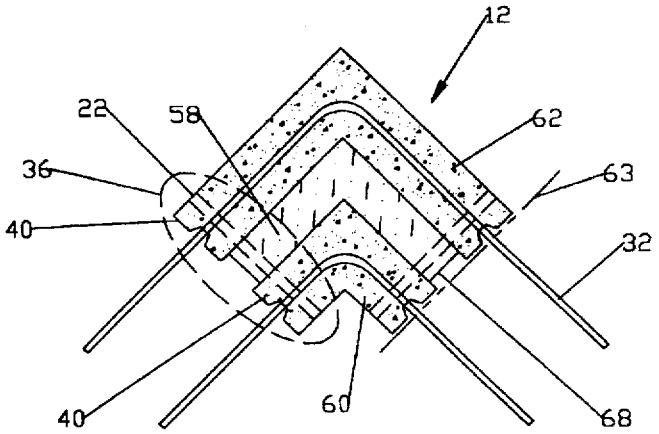
FIG 3-B
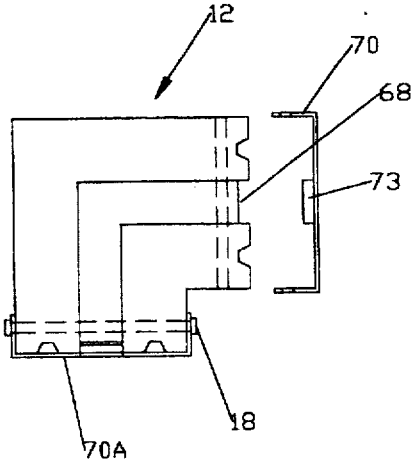
FIG 3-C

FIG 8-A

UNINSULATED AND INSULATED CONCRETE BUILDING STRUCTURE PRODUCTION IN SITU

BACKGROUND OF THE INVENTION

1. Field of Invention

The present invention relates to a new apparatus for the rapid forming and simultaneous continuous casting of concrete walls which may be intrinsically insulated at the time of production.

2. Description of the Prior Art

The use of concrete in construction has been documented for centuries. Naturally occurring cement was mined by the Romans and used to produce concrete in the construction of their aqueduct systems. It is widely used today. Concrete is relatively inexpensive, can be molded to any shape, is fireproof, and has superior compressive strength. Because of concrete's advantages as a building material many efforts have been made to overcome the main disadvantages of concrete which include: 1. the need to confine a very heavy plastic substance within a mold or form until it has hardened in the desired shape, 2. the difficulty of producing concrete structures which are aesthetically pleasing in appearance, and 3. the poor insulating quality of concrete resulting in a high rate of heat transference through concrete structural walls.

To overcome disadvantage 1 above, a variety of increasingly sophisticated methods for forming concrete has been devised. Hand made or custom forms were used for many years, and they are still used today in limited applications. Because of their expense such custom built forms have been generally replaced by a multitude of forming "systems". Typical of these forming systems are the Symons Corporation systems, the Jahn System (Reg. TM), and systems marketed by the Burke Company. Most of these systems utilize opposed spaced forming panels such as those of Carlson et al. U.S. Pat. No. 4,708,315 which define the intervening forming cavity or void into which fleshly mixed concrete is placed until it hardens. The majority of these systems utilize a multitude of metallic ties which connect the forming panels by spanning and thus defining the forming void. These ties maintain the positions of the opposed forming panels and keep them from separating as the concrete is placed. Most of these types of ties remain within the hardened concrete wall, and their protruding ends are broken off near the wall surface. While these systems offer some advantages over hand formed methods, they are still very costly to use because of the amount of labor and materials required in their utilization. Any of the current forming systems requires a plethora of forming panels, ties, retainer brackets, spreader brackets, panel studs, walers, form braces, etc. to utilize the systems. Any sizable construction project site is cluttered with thousands of individual forming parts, some of which become misplaced or damaged. Forming of even relatively simple structures may take weeks to months depending on the size of the structure involved. Many forming systems for monolithic pours require completion of the entire form before concrete placement begins. Laborers find themselves at the tops of tall completed formwork trying to place concrete into a narrow forming void to a level many feet below them. Precise quality control of concrete placement to the lower reaches of the forms becomes very difficult under these circumstances.

The walls produced by these systems are almost never aesthetically pleasing to the eye in their unadorned state (disadvantage 2). Therefore these methods are most frequently used for foundations and basements which are hidden from view, where strength and not appearance is the most important consideration. Many of these patented forming systems have now entered the public domain.

Efforts have been made to overcome the heat transference problems of concrete (disadvantage 3). In order for concrete buildings to be comfortable in most climates and in order to meet building code requirements, the exterior walls of such structures must be insulated. In practice, an insulating layer is usually added to the inside or to the outside surface of all exterior concrete walls leaving the exposed insulating material susceptible to damage. Protection of the insulation requires the installation of yet another barrier at additional cost. An alternative is to locate the insulating layer (usually a rigid foamed board) between an inner and an outer concrete panel resulting in a sandwiched three layered wall. This method protects the insulation from damage and offers the additional advantage of placing a large thermal mass (inner wall panel) within the insulation barrier. This thermal mass contributes to the temperature stability on the interior of the structure. Recognizing the distinct advantage of this type of wall Hull U.S. Pat. No. 5,222,338; Graham U.S. Pat. No. 5,119,606; Long U.S. Pat. Nos. 4,829,733, 4,805,366, 4,393,635, and 4,329,821; Asselin U.S. Pat. No. 4,545,163; Garrett U.S. Pat. No. 4,541,211; Taggart U.S. Pat. No. 4,426,061; Anzinger U.S. Pat. No. 4,422,271; Mulvihill U.S. Pat. No. 4,292,783; and Blum U.S. Pat. 3,750,355 have devised various insulated wall systems, some of which involve casting in situ while others involve the prefabrication of large tilt-up type panels. All of these systems continue to have one or more of the following disadvantages: 1. heat conduction bridges remain between the inner and outer concrete panels; 2. the insulation layer is not continuous and/or is penetrated by connecting rods; 3 traditional forming methods are used which are made even more costly and labor intensive by the addition of the insulation layer; 4. the methods are only suitable for large prefabricated panel assembly; 5. the results have poor visual appeal; or 6. the methods are too costly.

Even though concrete can be used to build safe, comfortable, and attractive structures, its use as the primary building material in general construction has not reached its full potential. This is because whatever advantages prior art forming methods possess, they still do not produce a concrete product which has broken the thresholds of acceptability and affordability for the reasons given above. These shortcomings of older methods became the inspiration for the present invention.

OBJECTS AND ADVANTAGES

While reviewing the prior art, a realization occurred that there was a way to build with concrete which would overcome the previous limitations. Accordingly the objects of the present invention became as follows.

Of foremost importance was the goal of producing concrete structures which were attractive, habitable, and affordable. This was accomplished in the following manner. The number of forming material parts needed was drastically reduced, and their structure was simplified. Premanufactured Angle Units were devised in which the majority of the technology for the forming process was concentrated. These angle units were to be produced with precise quality control in a factory environment and yet were to be small enough to be easily transported to the construction site. The angle units were to be utilized with distinct forming panels. Emphasis was placed on the accuracy, reliability, and quick assembly of the forming components. The invention was to be easily adaptable to the construction of both large and small structures while allowing a maximum flexibility of floor plans. The walls of such structures would be produced in situ in one monolithic pouring of reinforced concrete. Embedded wall ties, spacers, and other consumable materials were to be avoided. Additional objects of the invention were to include a much improved wall from an aesthetic standpoint, simplified finishing for exposed surface walls, and the option of adding a layer of insulation to the midst of any desired wall without significantly slowing production.

Using this invention and starting with ordinary footing structures alone, relatively large structures were to be completely formed and poured to the point of multistory wall completion which were internally insulated and ready for placement of roof trusses within several work days. It is conceivable that the ultimate goal of the invention would be to have skilled workmen complete such structural shells in one extended workday of 8–12 hours. Other advantages of this invention will become readily apparent from the following description and drawings.

BRIEF DESCRIPTION OF THE DRAWINGS

FIG. 3 Cross section from FIG. 2

FIG. 3-A Detailed section of a "leg" of a PAU

FIG. 3-B Detailed section of a typical Insulated Premanufactured Angle Unit or IPAU FIG. 3-C Detail of shipping brackets and Insulated Premanufactured Angle Unit or IPAU FIG. 4 Forming panel detail and assembly to an angle unit FIG. 4-A Cross section of a pair of assembled forming panels FIG. 5 Sectional view of an insulated concrete wall, angle unit, and forming panels FIG. 6 Outlines of a sampling of uninsulated angle units FIG. 7 "Enhanced" insulated angle unit outlines FIG. 8 Perspective view of insulation strut FIG. 8-A Perspective rear view of insulation strut FIG. 9 Lateral view of insulation strut FIG. 10 View of placement of insulation struts FIG. 11 Perspective view of commercial building wall section sample

NUMBER REFERENCE LIST

Figure 1:
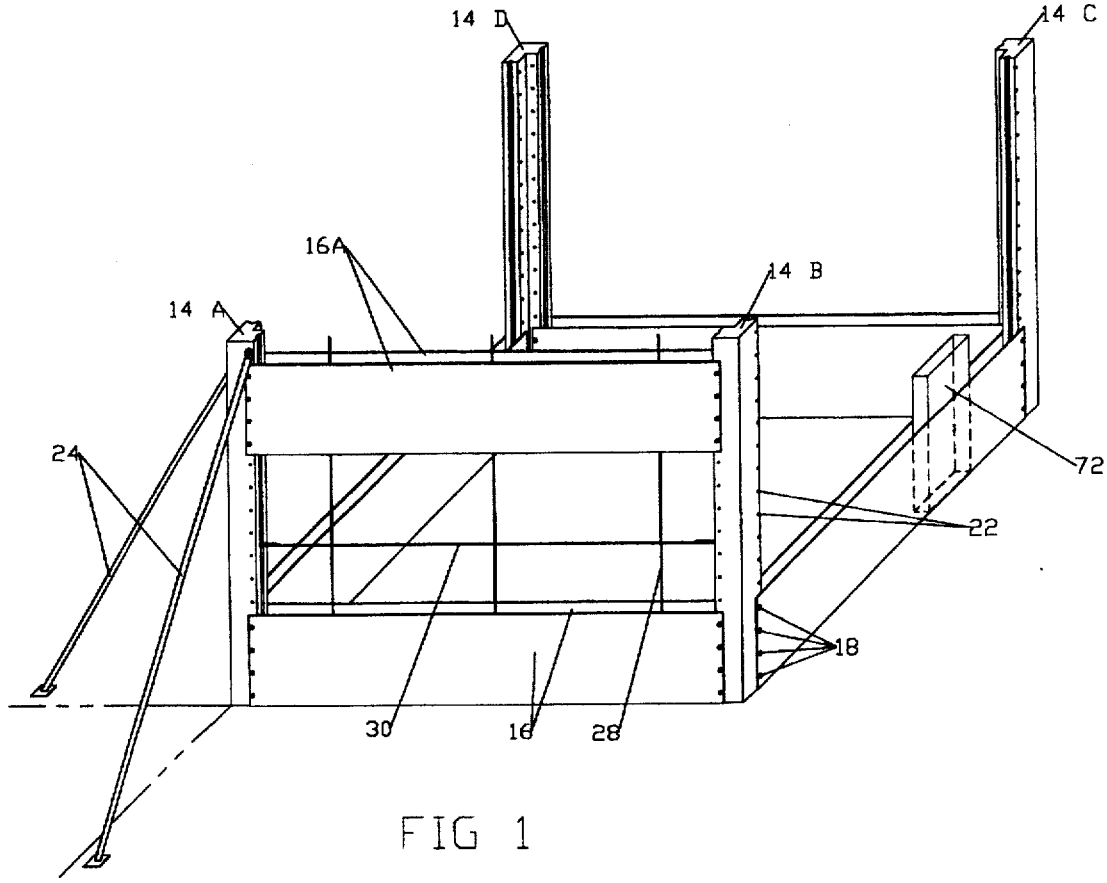
FIG. 1 Overview of the method being used to build a simple structure

12 Insulated Premanufactured Angle Unit or IPAU
14 Premanufactured Angle Unit (uninsulated) or PAU
16 Forming panel
16A Forming panel used as a spacer
18 Retainer
19 Device for securing forming panel
20 Forming panel retainer hole
21 Forming panel surface
22 PAU or IPAU retainer hole
24 Angle brace
26 Vertical steel bar placement template
28 Vertical steel bar
30 Horizontal steel bar
32 Stub of horizontal steel bar
33 Steel bar splicing overlap
34 Concrete
36 Leg of PAU or IPAU
37 Angle unit body
40 Bonding surface
42 Key
46 Reinforcing ribs
48 Sleeve
49 Forming void
50 Sleeved retainer hole
51 Female aligner
53 Male aligner
54 Hole for securing vertical steel bar
58 Insulation layer-intrinsic to IPAU
59 Rigid board insulation-added to formed wall
60 IPAU inner concrete layer
62 IPAU outer concrete layer
63 Bonding surface plane of IPAU leg
64 Inner formed concrete wall panel
66 Outer formed concrete wall panel
68 Insulation retention groove
70 Shipping bracket
70A Shipping bracket installed
72 Wall aperture void
73 Shipping bracket spacer
81 Rectangular column enhancement with fluting
82 Quoin enhancement
83 Pilaster enhancement
84 Round fluted column enhancement
85 Insulation strut, base
86 Insulation strut, arm
87 Insulation strut, retrieval holes
88 Insulation strut, fixation hole
89 Insulation strut, tip
90 Insulation strut, tooth
91 Insulation strut unit
91A Insulation strut, being inserted
91B Insulation strut, in position
91C Insulation strut, being retrieved
92 Ninety degree IPAU incorporated in wall without enhancement
94 Tee shaped IPAU incorporated in wall with quoin enhancement
96 Ninety degree IPAU incorporated in wall without enhancement

SUMMARY OF THE INVENTION

The invention consists of a versatile concrete wall forming system which can be utilized in a wide variety of construction applications. Small segments of the walls and their junctures are precast and transported to the constructed site where they are quickly assembled to the remainder of the forming apparatus after which concrete is placed. A provision is made to permanently install rigid board insulation into the interior of such walls. The walls produced have the preformed segments incorporated into the structure which is produced. The method will drastically reduce the time needed for the construction of such walls while producing a superior product that is composed of readily available and inexpensive construction materials.

DETAILED DESCRIPTION OF THE INVENTION

The present invention is a means and method of construction of concrete structures. The method involves a "form and pour as you go" approach to construction which is enabled by the invention. To build a concrete structure with this system the first tier of formwork is placed, filled with concrete, and immediately followed by placement of the next tier of formwork and concrete. These steps are repeated without interruption until all walls are completed. This method may be used to rapidly produce a single wall or any combination of walls to produce an entire building shell of concrete plus some or all of the interior walls. The majority of the volume of the walls is cast in situ. A small percentage of the walls is comprised of precast terminal segments of the wall which become an integral part of the walls at the time of casting. These segments play a vital role in the forming and casting process. Individual elements are described below.

Figure 2:
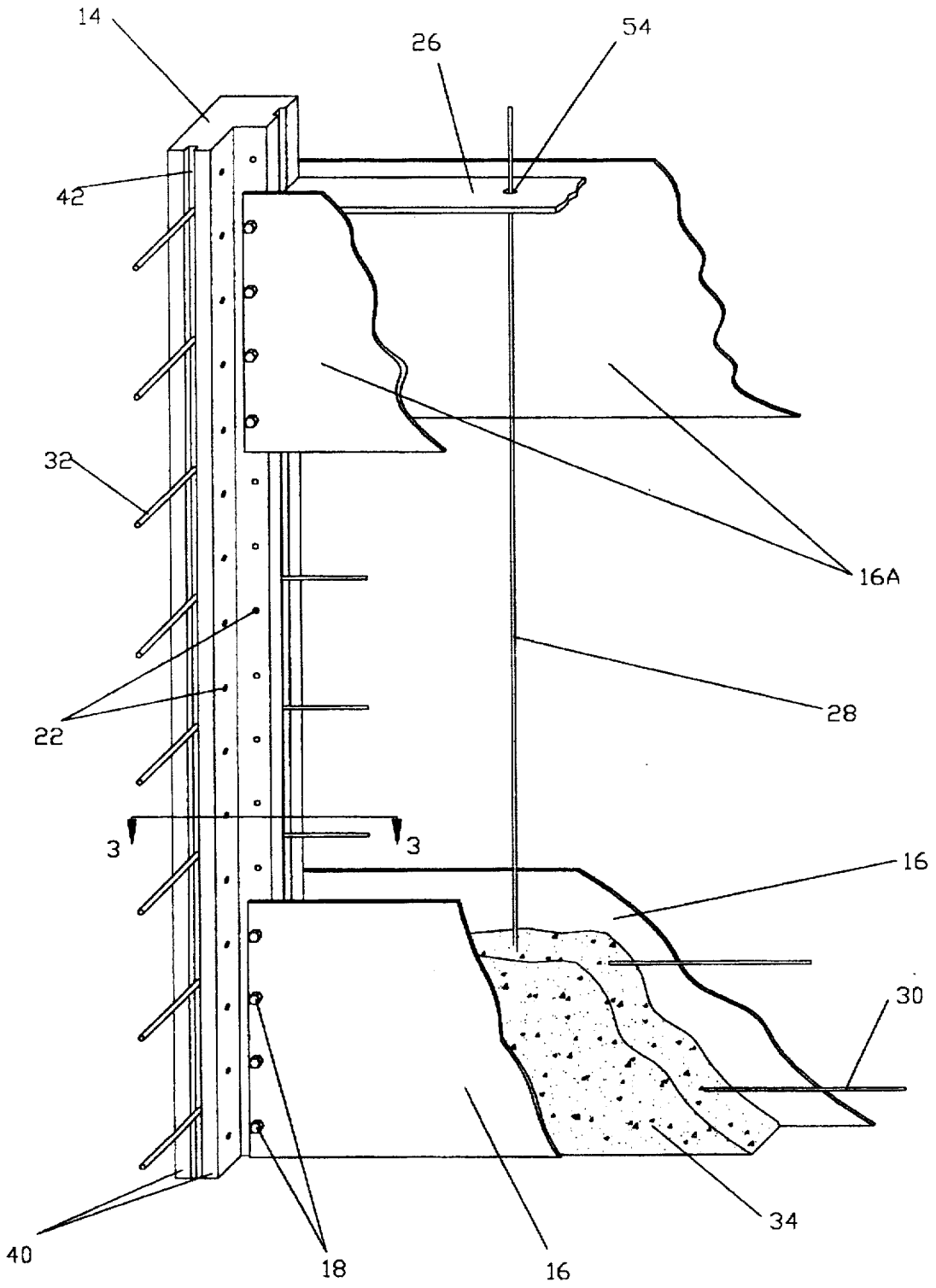
FIG. 2 Detailed view of a typical Premanufactured Angle Unit or PAU
Figure 6:
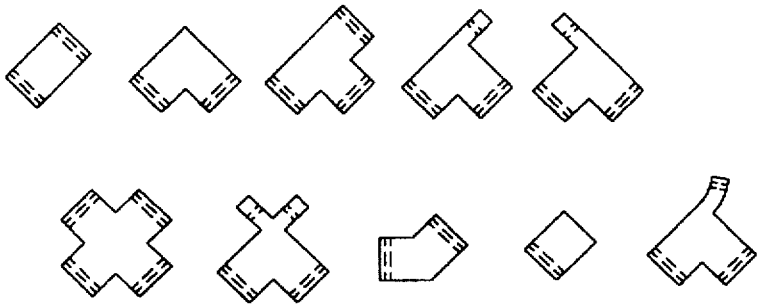

PREMANUFACTURED ANGLE UNITS, UNINSULATED: Premanufactured Angle Units or PAUs 14 (and IPAUs 12 to be described below) are the most crucial part of the forming system. Refer to FIGS. 2, 3, and 3-A which show a perspective view, a cross sectional view, and a detailed leg view respectively of a typical PAU 14. PAUs 14 are manufactured with precision quality control at a remote facility and transported to the construction location. Each PAU 14 features one or more legs 36. FIG. 3 depicts a ninety degree angle PAU with two legs which are circled and labeled 36. Legs 36 are that portion of PAU 14 which contacts and is flanked by an attached pair of forming panels 16. Legs 36 are continuous with a central portion or body 37 of PAUs 14. Said body 37 is a corner or a juncture of converging walls. Body 37 is the remainder of PAU 14 which is not part of legs 36. Each leg 36 features three surfaces. The two opposite sides of each leg 36 are flat, parallel, and run the vertical length of PAU leg 36. A plurality of spaced angle unit retainer holes 22 is arrayed along the length of the sides of each leg 36. Retainer holes 22 extend directly from one side of leg 36 to the opposite side. Forming panels 16 are attached directly to legs 36 with a plurality of retainers 18 inserted through retainer holes 22. A forming void 49 FIG. 4-A is created by legs 36 separating attached forming panels 16. In FIG. 2 it is seen that the third surface running the length of leg 36 is a vertical bonding surface 40 to which the freshly mixed concrete adheres. Bonding surface 40 may be flat or may have special features to increase bonding surface area and adhesion such as a vertical key 42. FIG. 2 shows that bonding surface 40 has a plurality of steel bars 32 extending perpendicularly out of surface 40. The cross sectional view of PAU 14 FIG. 3 shows that steel bar stubs 32 are extensions of a single continuous steel reinforcing bar which courses through PAU 14 and emerges from either side. Steel bar stubs 32 extend out of bonding surface 40 a predetermined distance to allow for a splicing overlap 33 with a plurality of horizontal steel bars 30 which are attached as the forming progresses. Steel bar 32 provides the continuity of steel reinforcement from one wall into the body of the angle unit and into an adjacent wall. Utility conduit stubs (not shown) may also be placed in PAUs 14 in a manner similar to the placement of bars 32. Vertical steel bar 56 intrinsic to PAUs 14 is shown in FIG. 3 and 3-A. Vertical steel bar reinforcement 56 extends the length of PAUs 14 and is vital to the strength of PAUs 14. Many variations of PAUs 14 can be produced, and FIG. 6 shows top outline views of a few uninsulated PAUs 14. In these views detail is omitted to show variations of the number, the thickness, and the angular orientation of legs 36. The actual angle orientation of legs 36 can vary from zero degrees to 360 degrees. All PAUs 14 have a plurality of legs 36 with zero or null angle units having two legs 36 which are superimposed. For practical purposes null angle PAUs 14 have one leg connected to the PAU body 37, and such null angle PAUs 14 are used at wall terminations. PAUs 14 are "pre-engineered" depending on the requirements of the structure being produced. This would include (1) determining the number of legs 36; (2) determining the angular orientation of legs 36; (3) determining the thickness of legs 36; (4) determining the height of units 14; and (5) making appropriate modifications of the steel reinforcement patterns for the different configurations of angle units 14.

INSULATED PREMANUFACTURED ANGLE UNITS or IPAUs: FIG. 3-B depicts a ninety degree angle Insulated Premanufactured Angle Unit or IPAU 12. IPAUs 12 function in a very similar manner as do PAUs 14 which they closely resemble and IPAUs 12 also represent a corner or a juncture of converging walls. IPAUs 12 contain an internal layer of insulation 58 between an inner concrete layer 60 and an outer concrete layer 62. It can be seen that the structure of inner layer 60 is identical to the structure of uninsulated PAU 14 just described above and shown in FIG. 3. Outer layer 62 is also similar to an uninsulated PAU 14 with the exception that bonding surfaces 40 are extended outward so that bonding surfaces 40 of inner and outer layers 60 and 62 lie in the same plane as shown by line 63. Interposed between the inner and outer layers 60 and 62 is a layer of suitable rigid board insulation material 58 thus making a three layer structure with retainer holes 22 extending through all three layers. It may be seen that the ends of IPAU legs 36 would have two parallel bonding surfaces 40 with two rows of steel bar stubs 32. Steel bar stubs 32 extend through the IPAU 12 concrete layers 60 and 62 in a manner identical to that described for uninsulated PAUs 14 which they resemble.

Vertical steel bar (not shown) intrinsic to each layer 60 and 62 of IPAUs 12 would also be placed in a manner similar to that of the uninsulated PAUs 14. Between the two IPAU 12 bonding surfaces 40 of each insulated leg 36 is the exposed end surface of IPAU insulation 58. Insulation 58 is recessed from bonding surface plane 63 to create insulation groove 68. Insulation 58 begins at one insulation groove 68, extends uninterrupted through the structure, and ends at the other insulation groove 68. Normally only two legs 36 of any IPAU 12 would be insulated, however uninsulated legs 36 may also be a part of that unit.

The introduction of an insulation layer 58 into IPAUs 12 creates a complication. Insulation 58 is the only structure between inner and outer concrete layers 60 and 62, and it provides no shear force protection against separation of IPAU 12 layers. Since each IPAU 12 is factory produced and shipped to the construction site, insulation 58 would be damaged, and the alignment of inner layer 60 to outer layer 62 would be lost during transportation. This is easily solved by the attachment of a plurality of shipping brackets 70 FIG. 3-C (cross sectional view only). Brackets 70 are shaped to conform to the outline of legs 36 of IPAUs 12 and have retainer holes which allow attachment of brackets 70 to IPAU retainer holes 22. They also feature a rigid spacer 73 which fits securely into insulation groove 68. When brackets 70 are installed on IPAU legs 36 as shown in cross section by bracket 70A and secured by standard retainers 18, inner and outer concrete layers 60 and 62 are held in secure alignment and insulation 58 is protected from shipping damage. Shipping brackets 70 are removed as needed at the project site.

Figure 7:
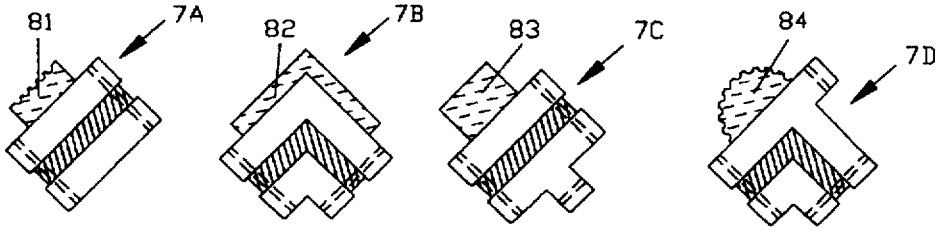

FIG. 7 shows the top view outlines of a limited sampling of possible variations of IPAUs 12. Each unit pictured has optional decorative features or enhancements which are shown in coarse broken cross-hatching including: A. a 180 degree wall continuation unit with a fluted rectangular column enhancement 81; B. a ninety degree angle unit with a quoin enhancement 82; C. a Tee unit with a smaller side wall and a pilaster enhancement 83; and D. a Tee unit with insulation turning 90 degrees and a fluted round column enhancement 84. Many other variations can be devised. As in the case of PAUs 14, all IPAUs 12 are pre-engineered to meet the requirements of the structure being constructed.

PAUs 14 and IPAUs 12 have the following characteristics: 1. The heights of PAUs 14 and IPAUs 12 determine the heights of the wails to be formed; 2. Units 12 and 14 align the entire formwork structure and keep it level and plumb during forming and casting; 3. Legs 36 determine the width of the walls to be produced by separating opposed forming panels 16 attached to legs 36 thus creating forming voids 49 into which freshly mixed concrete is placed; 4. Legs 36 determine the number of walls to be cast at that juncture of walls, the wall origins, the angular orientation of the walls, and they secure forming panels 16; 5. Legs 36 determine which formed walls will be insulated; 6. Steel bar stubs 32 determine the placement of horizontal steel 30 in the formed wall and provide for splicing overlap 33; 7. Legs 36 provide bonding surface 40 for the cast wall; 8. Units 12 and 14 are precast junctures of the walls to be formed; 9. Legs 36 are incorporated into the walls being cast becoming its lateral terminal segments which are a very small percentage of the volume of each wall; and 10. Legs 36 are made as short as possible to minimize the shipping weight of angle units. In addition IPAUs 12 contain insulation layer 58 and provide a means for the placement of insulation in the entire outside wall of the structure. Both IPAUs 12 and PAUs 14 are distinct units of manufacture that work only in conjunction with forming panels 16 described in detail below.

Figure 4:
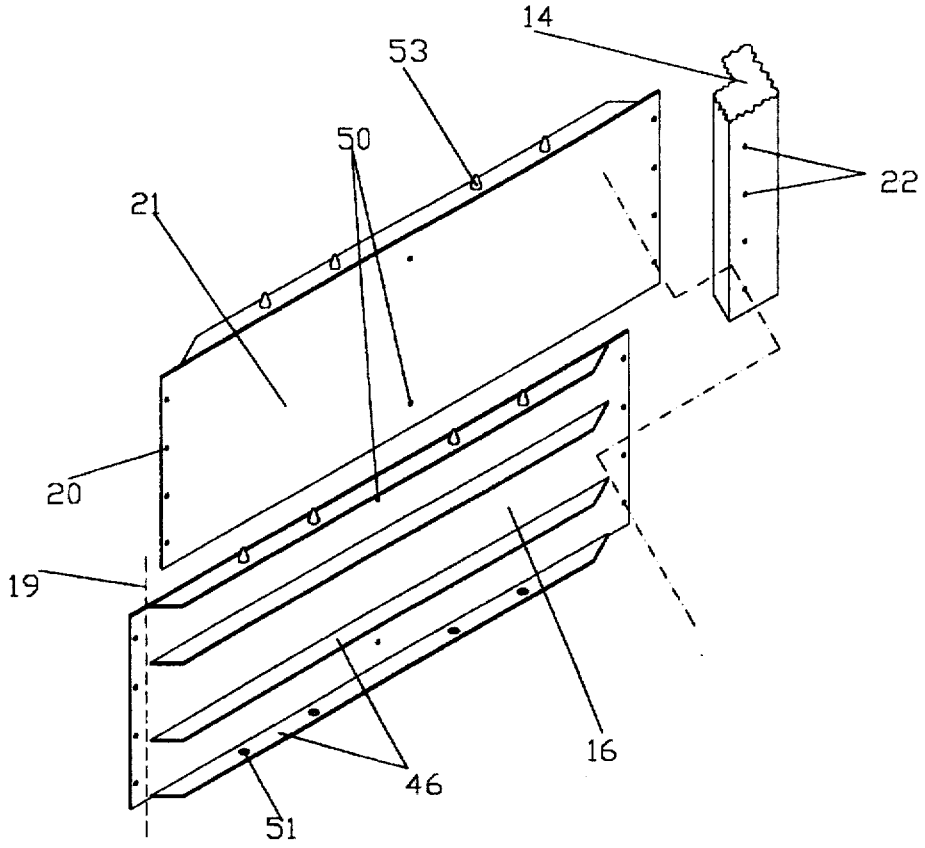
Figure 4A:
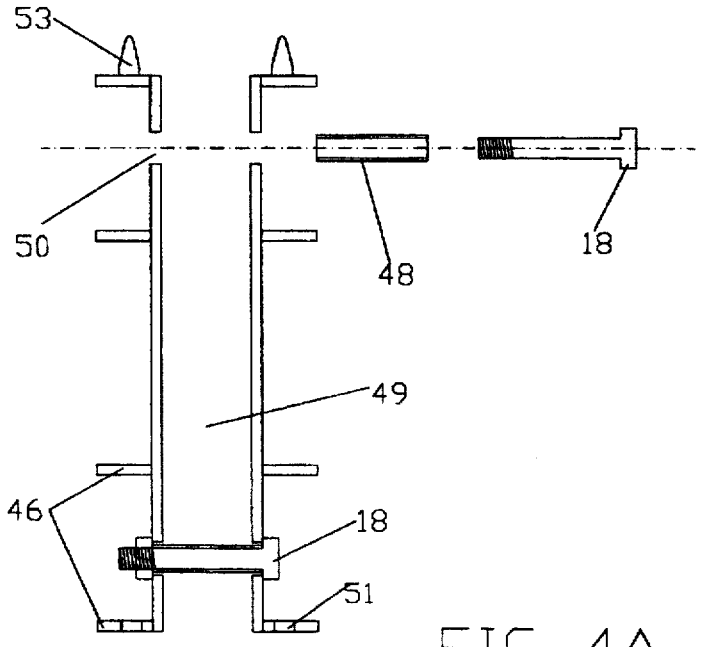

FORMING PANELS: FIGS. 4 and 4-A show the structure of forming panels 16. Panels 16 are made of metal plate, are usually rectangular and flat in shape, and could be made to any dimensions. Other shapes including curved and triangular panels and the like could be produced. Panels 16 are utilized in matched opposed pairs. The most common type utilized would be flat paired panels 16 which are identical and reversible. Their separated but parallel surfaces define forming void 49 into which freshly mixed concrete is placed. The ends of all forming panels 16 are modified to become an attachment device delineated by a line which is labeled 19. Device 19 has a plurality of forming panel retainer holes 20. The size and spacing of holes 20 match the size and spacing of holes 22 in legs 36 of IPAUs 12 and PAUs 14. Retainers 18 firmly attach pairs of panels 16 to the opposite sides of each leg 36 by spanning retainer holes 20 and 22. The width of angle unit legs 36 determines the width of the wall to be produced by separating opposed forming panels 16. A plurality of horizontal stiffeners or ribs 46 are permanently secured to and extend along most of the length of forming panels 16. When panels 16 are secured to angle units 12 and 14, ribs 46 prevent lateral deflections of the midspan portions of panels 16 caused by the lateral hydrostatic pressure of plastic concrete placed in forming void 49. Since panels 16 may be made to any dimension, the number and size of ribs 46 would be determined by the lateral pressures created by the placed concrete and by the length of panels 16. Since no expendable form ties are used in this method and since panels 16 are affixed only at their junctures with angle units 12 and 14, longer panels 16 would reach a length such that good engineering practices and practical considerations of excessive bulk and weight would not allow reinforcement of panels 16 with ribs 46 alone. Longer panels 16 would have rib strength augmented by sleeved retainers 48 and 18. Preliminary engineering estimates indicate that sleeved retainers 48 and 18 would be needed approximately every 7–8 linear feet of forming panel 16 depending on the material used in the manufacture of panels 16. Sleeved retainer holes 50 would be lined with sleeves 48 FIG. 4A which could be made of any suitable thin walled hollow cylindrical material of appropriate diameter which is cut to a length to extend from the outside surface of one forming panel 16 to the outside surface of its opposed mate. Standard retainers 18 are inserted through sleeves 48 and secured. Thus installed sleeved retainers 18 and 48 would prevent midspan separation of longer panels thus maintaining them in an opposed parallel relationship, and allow a reduction in the size of rib 46 material which would be needed for reinforcement of panels 16. Sleeves 48 allow withdrawal of retainers 18 after the concrete hardens, and sleeves 48 could also be removed if necessary.

On the upper edge of each forming panel 16 are placed a plurality of tapered male aligners 53 FIG. 4 and 4-A. Corresponding female aligners 51 are arrayed along the bottoms of each panel. As each panel 16 is set into place, aligners 53 and 51 would automatically align the abutting edges of panels 16 and provide mutual reinforcement between adjacent panels. Male 53 and female 51 aligners would be attached to or directly be a part of ribs 46 along the forming panel edges or they could have their own mounting brackets.

An inside forming surface 21 of each forming panel 16 is seen in FIG. 4 to be a flat plane which is uninterrupted except for occasional sleeved retainer holes 50 which are seen only on longer panels 16. It may also be seen that attachment device 19 is simply an extension of forming panel surface 21 which has been altered by the placement of holes 20. When panels 16 are attached to PAUs 14 and IPAUs 12, devices 19 are in contact only with legs 36. Thus devices 19 are distinguished from forming surface area 21 by their lack of contribution to forming surface area 21. It is also noted that devices 19 extend well into but not quite to the inside corners of the angle units 12 and 14. Vertical rib reinforcement (not shown) and horizontal ribs 46 do not extend onto the outside surfaces of devices 19 to the extent that they would interfere with the positioning or the securing of panels 16. This close approximation of forming panels 16 to the inside corners of angle units 12 and 14 allow legs 36 to be short thus reducing the shipping weight of angle units 12 and 14.

Characteristics of forming panels 16 are: 1. Fiat metallic forming surfaces 21; 2. No provision for standard ties; 3. Infrequent sleeved retainer holes 50 are present on longer panels 16; 4. Modification of the panel ends into devices 19 for attaching panel 16 to PAUs 12 and 14; 5. Reinforcement ribs 46 located so as to not interfere with attachment devices 19 function; and 6. Male aligners 53 on upper edges and female aligners 51 along lower edges of panels 16 for alignment and mutual reinforcement.

Figure 8:
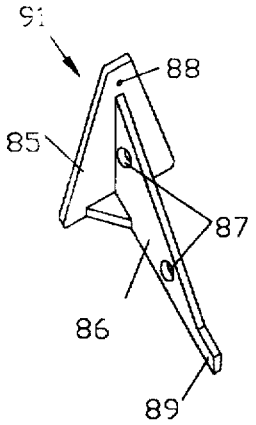
Figure 9:
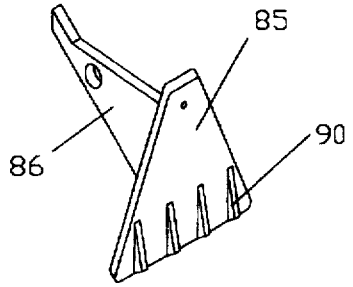
Figure 9:
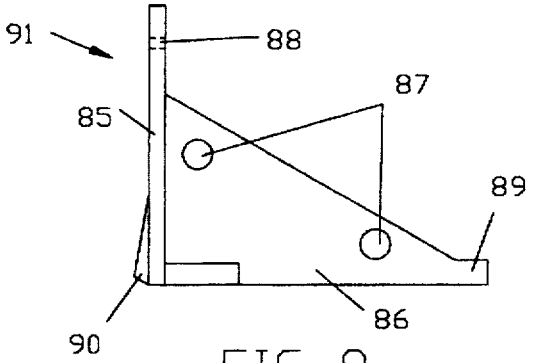
Figure 10:
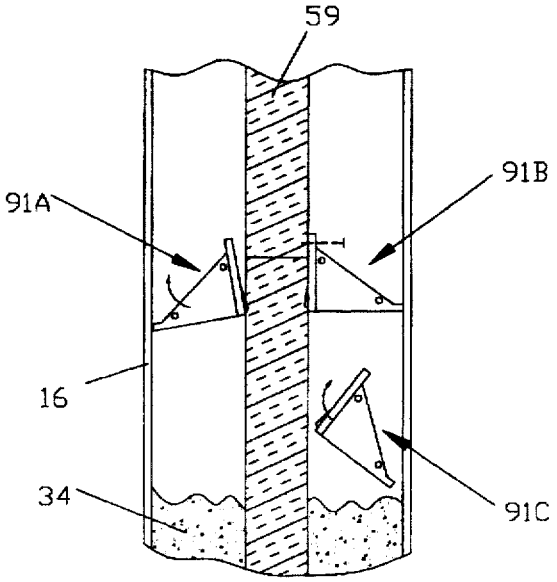

INSULATION STRUTS: Refer to FIGS. 8 and 8-A, perspective views, FIG. 9 a lateral view, and FIG. 10, a view showing insertion of insulation strut 91. Insulation strut 91 has a base 85 with a hole 88 near the top of its base 85. Attached to base 85 is a triangular strut arm 86 which tapers to a tip 89. The length of arm 86 allows pairs of struts 91 to securely position an insulation board 59 between two forming panels 16 as seen in FIG. 10. Strut arm 86 is braced for stability where it contacts base 85 FIG. 8. A plurality of retrieval holes 87 are located on strut arm 86. On the back of base 85 are a plurality of insulation gripping teeth 90 which are seen in FIG. 8-A and FIG. 9. Teeth 90 are triangular in profile with their long side attached to base 85.

The short sides of the triangles are located inferiorly and the intermediate length sides are located superiorly. FIG. 8-A is a view of base 85 which shows that individual teeth 90 are narrow in width thus allowing teeth 90 to make narrow shallow linear impressions into insulation 59 when struts 91 are properly placed in position. FIG. 10 shows a cross section of two insulation boards 59 being positioned between two forming panels 16. Strut 91 is being inserted at 91A by digging teeth 90 of strut 91 into insulation 59 and rotating tip 89 upward as indicated by the small arrow until base 85 is flat against the two insulation panels 59. At this point strut 91 is locked into position by the pressure of tip 89 against forming panel 16, by the pressure of base 85 and teeth 90 against insulation 59, and by another strut 91 exerting an opposing pressure on the other side of insulation 59. Struts 91 are always utilized in opposed pairs. Struts 91 may additionally be secured by common box nails or other similar devices inserted through holes 88 and into insulation board 59. Opposing strut 91B is in position opposite strut 91A. Strut 91C is being removed by hooking through hole 87 with a hooked tool or device (not shown), rotating base 85 upward as shown by the small arrow at 91C, and withdrawing strut 91C. It may be seen that the off center location of tip 89 to base 85 facilitates the upward rotation of base 85 for removal of strut 91. In addition the shape of insulation teeth 90 help secure base 85 to keep it from slipping downwards and yet allow base 85 to be rotated upwards for easy removal. The impression of teeth 90 into insulation board 59 also helps keep strut 91 locked against insulation 59. Struts 91 may be made of any suitable material and mold-injected plastic would be ideal.

GENERAL CONSIDERATIONS: The main individual elements of the forming system are described in prior text. Other items utilized in the method are commercially available adjustable angle braces 24 used in concrete construction and retainers 18 which are ordinary nut and bolt units of suitable length and diameter. In subsequent text, when a retainer 18 is stated to be inserted, placed, or secured it is understood that a bolt and nut unit have been installed properly and tightened. Additionally the nut portion of the unit may be affixed to forming panels 16 to further speed the forming process. Vertical steel bar schedule templates 26 FIG. 2 are merely pieces of any flat material of suitable dimension with holes 54 drilled at intervals as specified by the building design and the vertical steel bar placement schedule. Templates 26 are suspended between spacer panels 16A FIG. 2 by simple angle brackets (not shown) where they secure the upper ends of vertical steel bar 28. Specially made adjustable and reusable templates may be easily devised as a substitute.

METHOD OF OPERATION:

FIG. 1 is a typical initial stage of forming for the production of a simple quadrilateral structure which was reached in the following sequence. On a suitable standard footing (not shown) the first PAU 14A is hoisted into place, leveled with shims at its base, plumbed vertically, and secured with adjustable angle braces 24. Two forming panels 16 are placed in position at the base of PAU 14A and secured to its leg 36 with retainers 18. Next PAU 14B is placed at the other end of panels 16 and similarly leveled, plumbed, and secured to panels 16 with retainers 18 and braces 24 (see note below). Two additional forming panels 16A are inserted and secured between the upper portions of PAUs 14A and 14B. Panels 16A are identical to panels 16 and are given the "16A" designation to indicate that they are temporarily used as spacers and secured to the upper ends of PAUs 14 to keep them parallel. Additional paired panels 16, PAUs 14C and 14D, adjustable braces 24, and panels 16A are added in sequence around the footing of the structure to complete the first tier of forming.

(Note: for clarity most of angle braces 24 and panels used as spacers 16A are not illustrated in FIG. 1. Similarly in this and in other figures certain features were omitted in the interest of clarity i.e. steel bar stubs 32, certain hidden lines, etc. These intentional omissions help rather than detract from the understanding of the drawings and reference should be made to the detailed description of the elements above for specific features.)

Template 26 for vertical steel bar 28 placement is suspended by its angular brackets (not shown) in position between the tops of spacer panels 16A FIG. 2. The upper ends of vertical steel bar 28 are inserted through template holes 54. Thus secured at their tops, the bottoms of bars 28 are set in place on the footings. Precut horizontal steel bar 30 is placed between each pair of PAUs and wire tied to vertical steel bar 28 and spliced to steel bar stubs 32. These measures produce the stage of forming as shown in FIG. 1 (again see note above), and the initial placement of concrete is begun.

FIG. 2 shows concrete 34 placement between forming panels 16. The rate and height of placement of each tier of concrete would be closely controlled to allow hardening of lower layers to prevent form "blowout". Such methods are used routinely in the building industry. When concrete 34 placement has reached a level just below the tops of forming panels 16 as depicted, additional horizontal steel bar 30 is tied in place. Then the next tier of forming panels 16 is placed and secured to PAUs 14 followed by the controlled addition of more concrete to the tops of the second tier. When repetition of these steps approaches the tops of PAUs 14, templates 26 are removed and panels 16A which were used for spacing PAUs 14 are moved down to form the next to the last tier of formwork. The last tier is formed by additional sets of panels 16. As the forming structure is assembled, utility conduits for the formed walls are attached to utility conduit stubs (not shown) in the PAUs 14. Voids for windows, doors, and other apertures 72 FIG. 1 would also be placed. It can be seen that because of the unique design of this forming method, as each tier of forming is added, the entire structure of the formwork unit becomes stronger and more rigid.

Figure 5:
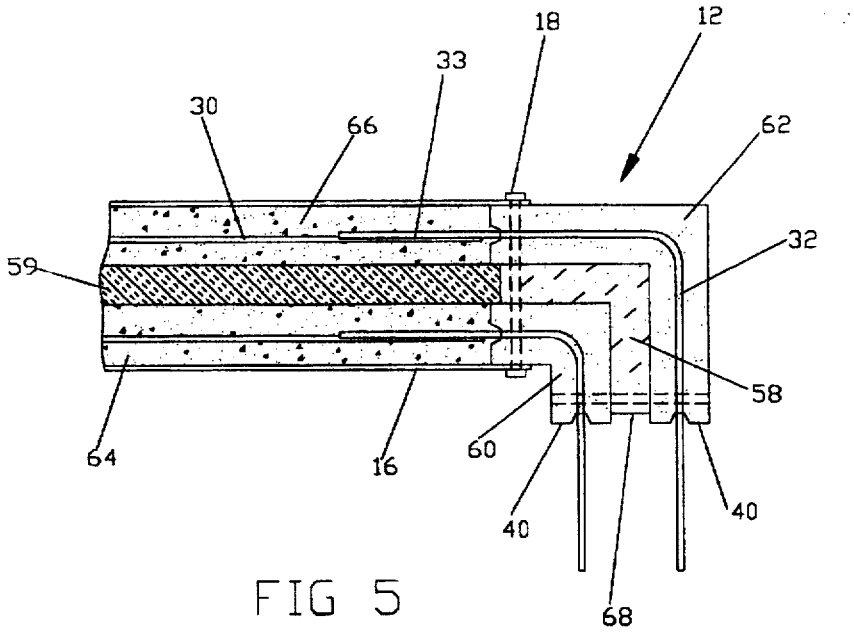

So far a single thickness uninsulated concrete wall structure has been described. Production of a similar quadrilateral structure made of insulated concrete uses the same method of forming with the following modifications. Insulated Premanufactured Angle Units or IPAUs 12 are substituted for PAUs 14 for all walls which require insulation. IPAUs 12 are placed and secured to forming panels 16 and 16A in an identical manner as for the previously described uninsulated structure. Rigid board insulation 59 FIG. 5 is fitted and assembled with commercially available adhesives. The ends of assembled insulation boards 59 are inserted into insulation grooves 68 of IPAUs 12. Grooves 68 assist in fixation of boards 59 as concrete is poured. Vertical and horizontal steel bar is added in duplicate rows for inner 64 and outer 66 walls. Then forming panels 16 are attached to IPAUs 12 and secured by retainers 18. Opposed pairs of insulation struts 91 FIG. 10 are inserted between forming panels 16 at appropriate intervals on opposite sides of sections of insulation 59. Strut 91 design would hold inserted pairs of struts 91 in place, but they could be additionally secured by pushing a common box nail or other similar device through hole 88 and into insulation board 59. With insulation 59 thus secured between forming panels 16 by struts 91, by grooves 68, and by adhesive between insulation board 59 sections, concrete 34 can then be placed on both sides of insulation 59 to form an inner 64 and an outer 66 wall without displacement of insulation 59. As concrete 34 level rises and approaches struts 91, struts 91 are retrieved and reused at a higher level. After struts 91 are removed, insulation 59 is held in place by concrete 34 on either side of insulation 59.

In comparison to uninsulated walls, insulated walls require approximately twice the amount of concrete and steel as do their uninsulated counterparts since a duplicate concrete wall is produced. IPAUs 12 are thicker than their uninsulated counterparts, and because of wider IPAU legs 36, retainers 18 would be longer. IPAUs 12 have shipping brackets 70 FIG. 3-C which must be removed as the forming process progresses. Vertical steel bar templates 26 must also have a double row of retainer holes 54 to secure the upper portions of vertical steel bar 28 for the inner and outer wall panels 64 and 66. Insulation is placed and secured with adhesives, insulation grooves 68, and struts 91. Even with these noted exceptions the construction of the two types of walls is very similar.

Figure 11:
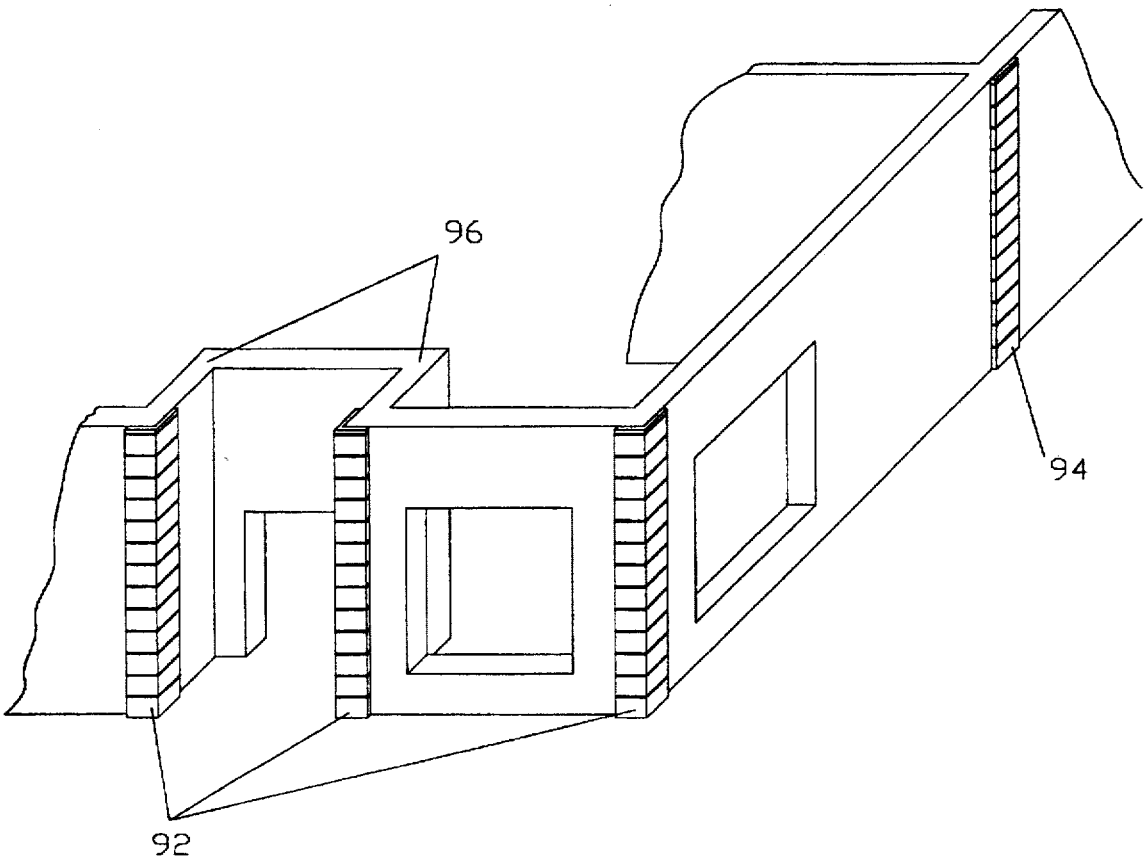

While the method described so far produces a high quality concrete surface, it still requires embellishment to become aesthetically acceptable. All IPAUs 12 and PAUs14 have the capability of being "enhanced". Legs 36 of units 12 and 14 are small segments of the walls being produced and cannot be altered where they contact forming panel fixation devices 19. However, the intervening bodies 37 between legs 36 of angle units 12 and 14 can have molded enhancements created during factory production, and these enhancements may protrude outward beyond the plane of the wall being cast. Some of the enhancements would include quoins, cornerstones, pilasters, round and rectangular columns with or without fluting, capitals, bases, decorative artwork, company symbols and logos, and other enhancements. The enhancements would greatly improve the appearance of the structure being produced by breaking up the monotony of an otherwise featureless flat concrete surface. FIG. 7 shows some enhancements (coarsely cross hatched) which could be added to a variety of insulated units 12. These enhancements may also be added to uninsulated units 14. FIG. 11 shows a wall segment of a commercial building shell constructed with the use of quoin enhanced ninety degree IPAUs 92, unenhanced ninety degree IPAUs 96, and a quoin enhanced Tee IPAU 94. The walls between angle units 92, 94, and 96 would usually be flat although forming panels 16 could be lined by surface texturing inserts during production. When forming panels 16 are stripped, all exterior wall retainer holes are filled with insulation plugs and every retainer hole is sealed with mortar. This last step leaves a wall with a continuous uninterrupted insulation barrier between the inner and outer structures of the entire outside wall. Additional finishing such as a coat of plaster, stucco, or a brick veneer would be simplified by the high quality of the surface produced by the method.

CONCLUSIONS, RAMIFICATIONS, AND SCOPE:

The above specification describes a highly versatile system for the construction of concrete structures. The essence of the invention is the wall forming system which consists of the angle units 12 and 14 and their interaction with forming panels 16. By utilizing various angle units 12 and 14 including those with enhancements and combining them with a variety of forming panel 16 lengths, very complex, yet attractive buildings can be constructed. Although angle units 12 and 14 may have many variations they still retain a distinct identity with the characteristics indicated in the specification above. Buildings produce by this system could be built rapidly and accurately while keeping costs down both in the amount of labor expended and in the cost of materials consumed. The only materials consumed in this forming method are concrete, steel, insulation, a few inexpensive retainer sleeves 48, and of course the angle units 12 and 14 which are the most crucial parts of the forming system. Everything else is reusable. The accuracy and predictability of the system allows extensive advanced preparation of materials. Aperture voids 72 are premade; all vertical 28 and horizontal 30 steel bar is precut; steel bar modifications around voids is prefabricated and simply wire tied into place; floor and roof joists can be precut; etc.

Premanufactured angle units 12 and 14 are relatively small, light in weight, and easily transported to construction sites when compared to other larger types of prefabricated units, walls, and panels. Despite their small size they perform many vital functions, listed in the previous specification including expediting the construction. Once the initial tier of forming is assembled the remainder of the forming and pouring can proceed at a rapid rate. All that the workmen have to do is to tie horizontal steel bar 30, add insulation 59, connect the next pair of forming panels 16 with a few retainers 18, and add concrete 34 for each additional tier of construction.

This tiered method of forming and pouring these walls allows workers to more closely control the placement and consolidation of the concrete 34. This control prevents wall defects, especially around voids 72. Instead of working at the top of a completely formed wall, workers would be working at a vertical height of no more than one panel 16 width above the level of freshly poured concrete 34. This accessibility of the work area to the workmen allows superior control of concrete 34 placement.

Although the above specification contains many details of the invention, there are many anticipated variations such as angle unit configurations with partial legs 36 to place a wall on one floor of the structure and to omit that wall on a higher floor. The enhancement possibilities for the angle units are almost infinite. Forming panels 16 could be curved to form rounded structures or triangular in shape to form features such as gables. It is already anticipated that the method may even incorporate the production of the footing into the first tier of concrete placement without causing any delay or significant complication of the method.

Thus the scope of the invention is large, and its limitations should be determined by the claims section which follows rather than by the few examples given here.

What is claimed is:

1. A concrete wall forming system comprised of:

(a) a plurality of forming panels with:

(1) each said panel generally being a rectangular flat metallic plate, (2) each said panel having an inner flat planar forming surface, (3) each said forming surface being directly continuous with a panel attachment device or attachment means at each lateral end of each said panel, (4) each said panel having a plurality of strengthening ribs, (5) said ribs being located on the panel side opposite said forming surface, (6) said panels being utilized in matched pairs with said forming surfaces being spaced apart in opposed parallel configuration, (b) a plurality of angle units with:

(1) said angle units being the preconstructed junctions of two or more walls of a building shell, (2) said angle units being made of steel reinforced concrete, (3) said angle units having a body and a plurality of legs, (4) each said leg being a terminal segment of a building shell wall, (5) each said leg being of sufficient dimensions to completely define the origin, height, thickness, and angular orientation of any said building shell wall, (6) each said terminal segment having an angle unit attachment means, (c) two said angle units and two said matched forming panels in a combined assembly producing a forming void for the placement of steel reinforcement and freshly mixed concrete with:

(1) each said angle unit having one said terminal segment inserted between the lateral ends of each said panel pair, (2) said panel attachment means and said inserted segment attachment means being a mutually interactive combined attachment means with said combined attachment means being secured by a plurality of retainers, (3) said combined attachment means providing a means of maintaining the integrity, continuity, and all alignment of said forming void, (4) said void being generally rectangular in shape in horizontal cross section with a plurality of boundaries, (5) two said void boundaries being said opposed forming surfaces, (6) two other said void boundaries being two said terminal segments, (7) said forming void length being predetermined by said forming panel lengths, (8) said forming void width being predetermined by said terminal segment leg width, (9) said panels and said panel ribs in combination providing a means for the transferral of all vertical, lateral, and horizontal displacement forces exerted on said panels to said combined attachment means,

(10) said combined attachment means being located entirely outside of said forming void, and (d) said panels and said units in a plurality of combined assemblies creating a plurality of forming wilds for the placement of steel reinforcement and freshly mixed concrete for the walls of an entire structural shell with said angle units being incorporated into said building shell.

2. A system as in claim 1 with further provision for the placement of an intrinsic rigid board insulation layer into the interior of said structural shell walls with:

(a) said insulation completely separating said structural shell walls into an inner steel reinforced concrete layer and an outer steel reinforced concrete layer in a sandwiched configuration, (b) said inner and outer concrete layers being structurally independent with no mechanical interconnections, (c) said insulation layer extending throughout the entirety of all said structural shell walls, (d) said insulation layer's intrinsic physical and insulation performance characteristics being completely preserved throughout the extent of said structural shell walls, (e) said insulation layer being maintained in position during concrete placement by a removable insulation positioning means, and (f) said insulation layer placement and insulation performance preservation being enabled by said combined attachment means of said forming system being located entirely outside of said forming void.

3. A concrete wall forming system comprised of:

(a) a plurality of angle units with:

(1) said units being made of steel reinforced concrete, (2) each said unit being a juncture of a plurality of walls and a plurality of terminal segments of said walls, (b) a plurality of opposed pairs of generally rectangular, metallic, matched forming panels with a plurality of strengthening ribs, (c) said panels and said units having a mutually interacting means of attachment with:

(1) said attachment means enabling a combined assembly of said units and said panels to produce a forming void for the placement of freshly mixed concrete, (2) said attachment means being located entirely outside of said forming void, (3) said attachment means enabling said panel and angle unit combined assemblies to support and align said forming system in its entirety, and (d) said panels and said units in a plurality of combined assemblies creating a plurality of forming voids for the placement of steel reinforcement and freshly mixed concrete for the walls of an entire structural building shell with said units being incorporated into said building shell.

4. A concrete wall forming system for the production of a structural building shell as in claim 3 with further provision for the placement of a continuous layer of rigid board insulation into the interior of said building shell wall with:

(a) said insulation completely separating said building shell walls into an inner reinforced concrete layer and an outer reinforced concrete layer, (b) said inner and outer concrete layers being structurally independent, (c) said insulation layer being completely intact, extending throughout said building shell walls, and having no structural hiatus or compromise to its intrinsic physical characteristics of any kind, and (d) placement of said insulation layer being enabled by said angle unit and forming panel attachment means being located entirely outside said forming void.

5. A complete cast in situ building structural shell with a plurality of walls with each said wall comprised of:

(a) a continuous uncompromised barrier of rigid board insulation extending throughout all said shell walls, (b) an independent reinforced concrete shell wall lamination located exterior to said rigid insulation comprised of:

(1) a plurality of precast angle unit outer concrete layers, (2) a plurality of outer concrete wall panels with each said outer panel cast in place between two said angle unit outer layers and further providing substantially the vast majority of said outer shell wall lamination, (c) an independent reinforced concrete shell wall lamination located interior to said rigid insulation comprised of:

(1) a plurality of precast angle unit inner concrete layers, (2) a plurality of inner concrete wall panels with each said inner panel cast in place between two said angle unit inner layers and and further providing substantially the vast majority of said inner shell wall lamination, and (d) said interior and exterior concrete wall laminations being entirely independent entities with complete structural and mechanical separation by said continuous insulation barrier.

6. A structural building shell as in claim 5 with further provision for adding uninsulated walls to said insulated shell for any wall not requiring insulation.

* * * * *